US010693210B2

(12) United States Patent
Chattopadhyay et al.

(10) Patent No.: US 10,693,210 B2
(45) Date of Patent: Jun. 23, 2020

(54) METHOD FOR MAKING ANTENNA ARRAY

(71) Applicant: California Institute of Technology, Pasadena, CA (US)

(72) Inventors: Goutam Chattopadhyay, Pasadena, CA (US); Imran Mehdi, South Pasadena, CA (US); Choonsup Lee, La Palma, CA (US); John J. Gill, La Crescenta, CA (US); Cecile D. Jung-Kubiak, Pasadena, CA (US); Nuria Llombart, Delft (NL)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 87 days.

(21) Appl. No.: 13/869,292

(22) Filed: Apr. 24, 2013

(65) Prior Publication Data

US 2014/0144009 A1 May 29, 2014

Related U.S. Application Data

(60) Provisional application No. 61/637,730, filed on Apr. 24, 2012.

(51) Int. Cl.

| | |
|---|---|
| ***H01P 11/00*** | (2006.01) |
| ***H01Q 15/08*** | (2006.01) |
| ***H01Q 19/06*** | (2006.01) |

(52) U.S. Cl.

CPC ..... *H01P 11/001* (2013.01); *H01Q 15/08* (2013.01); *H01Q 19/062* (2013.01); *Y10T 29/49016* (2015.01)

(58) Field of Classification Search

CPC ... H01Q 19/19; H01Q 19/06; G06K 19/07749
USPC ..... 29/600–601, 592.1; 340/572.7; 343/700 MS, 574, 911 R
See application file for complete search history.

(56) References Cited

U.S. PATENT DOCUMENTS

| | | | | |
|---|---|---|---|---|
| 3,386,099 | A * | 5/1968 | Walter | H01Q 15/04 343/754 |
| 4,499,473 | A * | 2/1985 | Rao | 343/754 |
| 4,755,820 | A * | 7/1988 | Backhouse et al. | 343/700 MS |
| 5,781,163 | A * | 7/1998 | Ricardi | H01Q 15/08 343/754 |
| 6,246,369 | B1 * | 6/2001 | Brown | H01Q 1/40 343/700 MS |
| 6,590,544 | B1 * | 7/2003 | Filipovic | 343/753 |
| 7,253,789 | B2 * | 8/2007 | Kingsley et al. | 343/911 R |
| 8,658,976 | B2 * | 2/2014 | Sengupta et al. | 250/341.1 |
| 8,780,012 | B2 * | 7/2014 | Llombart et al. | 343/911 R |
| 2010/0328779 | A1 * | 12/2010 | Llombart et al. | 359/619 |
| 2012/0013517 | A1 * | 1/2012 | Lee | H01Q 13/22 343/785 |
| 2014/0144009 | A1 * | 5/2014 | Chattopadhyay et al. | 29/600 |

* cited by examiner

*Primary Examiner* — Minh N Trinh
(74) *Attorney, Agent, or Firm* — Gates & Cooper LLP

(57) ABSTRACT

A set of antenna geometries for use in integrated arrays at terahertz frequencies are described. Two fabrication techniques to construct such antennas are presented. The first technique uses an advanced laser micro-fabrication, allowing fabricating advanced 3D geometries. The second technique uses photolithographic processes, allowing the fabrication of arrays on a single wafer in parallel.

13 Claims, 9 Drawing Sheets

FIG. 13A
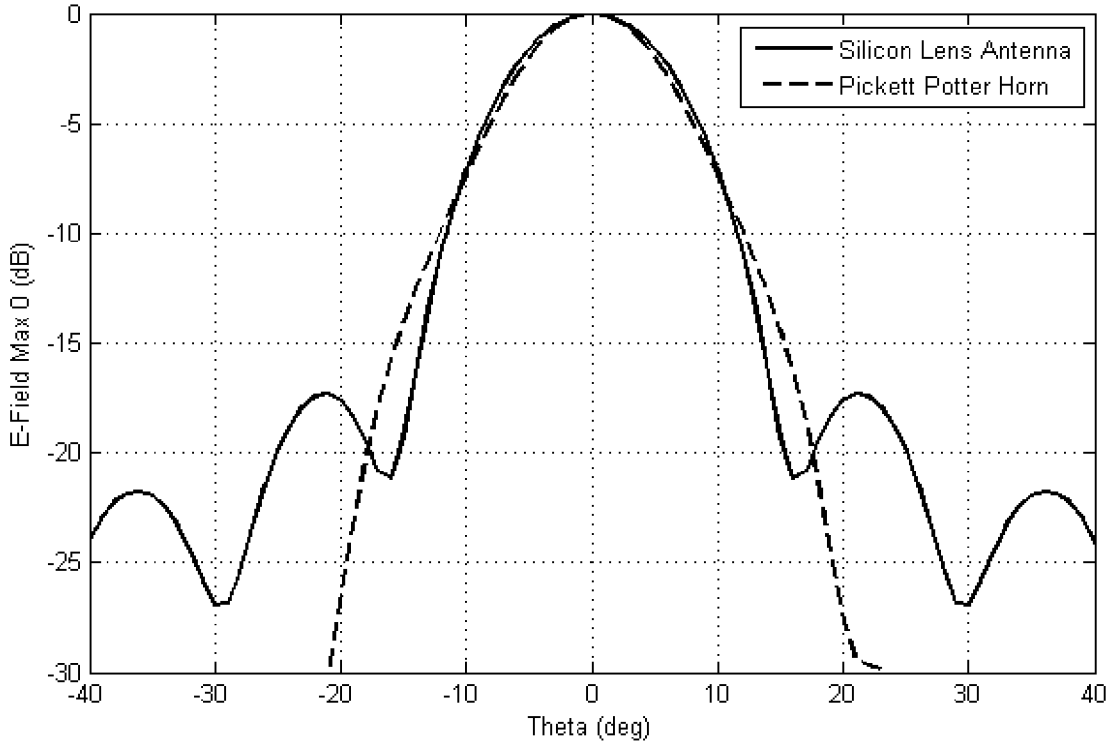
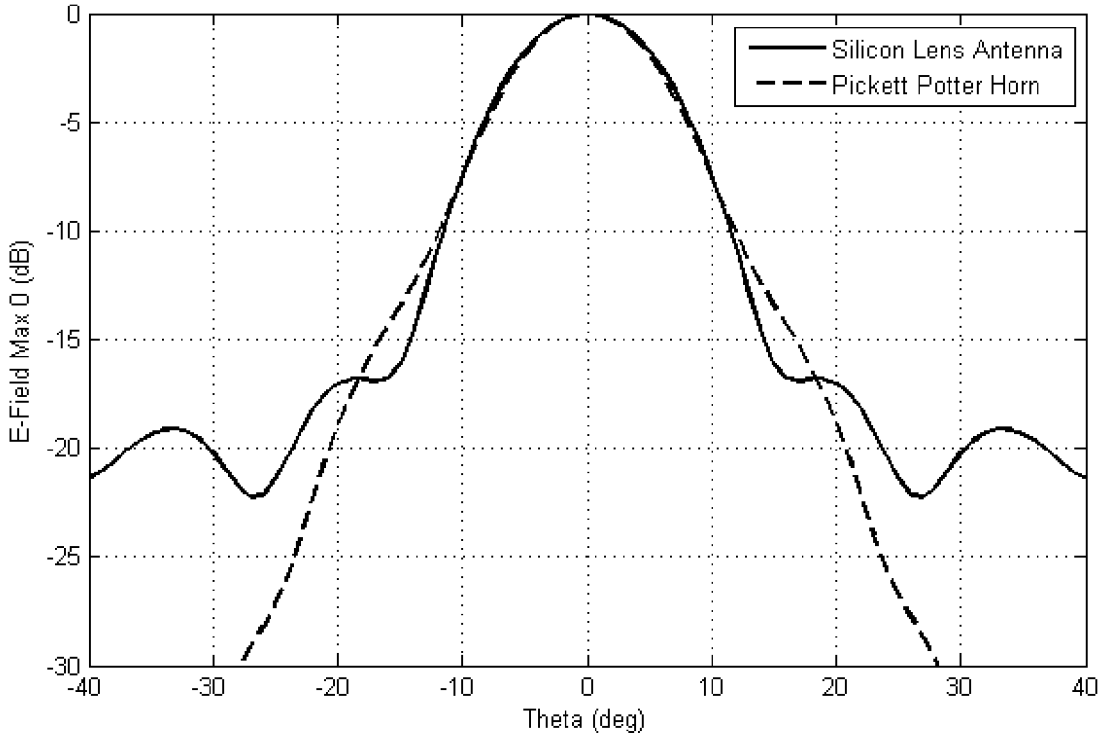
FIG. 13B

METHOD FOR MAKING ANTENNA ARRAY

CROSS-REFERENCE TO RELATED APPLICATIONS

This application claims priority to and the benefit of U.S. provisional patent application Ser. No. 61/637,730, filed Apr. 24, 2012, which application is incorporated herein by reference in its entirety.

STATEMENT REGARDING FEDERALLY FUNDED RESEARCH OR DEVELOPMENT

The invention described herein was made in the performance of work under a NASA contract, and is subject to the provisions of Public Law 96-517 (35 USC 202) in which the Contractor has elected to retain title.

FIELD OF THE INVENTION

The invention relates to microwave antennas in general and particularly to methods of fabricating antennas operating at terahertz frequencies from silicon materials.

BACKGROUND OF THE INVENTION

Recently, submillimeter-wave technology in general and heterodyne techniques in particular have been highlighted as an important imaging capability for both, ground based and space applications. See I. Mehdi, B. Thomas, C. Lee, R. Lin, G. Chattopadhyay, J. Gill, N. Llombart, K. B. Cooper, P. H. Siegel, "Radiometer-on-a-chip: A path towards super-compact submm imaging arrays" SPIE Defense, Security and Sensing, April 2010, Orlando, Fla.; K. B. Cooper, R. J. Dengler, N. Llombart, T. Bryllert, G. Chattopadhyay, E. Schlecht, J. Gill, C. Lee, A. Skalare, I. Mehdi, P. H. Siegel, "Penetrating 3D Imaging at 4 and 25 Meter Range Using a Submillimeter-Wave Radar," IEEE Trans. MTT., vol. 56, pp. 2771-2778, December 2008. Most heterodyne systems currently used provide sufficient science data in spite of being single pixel. However, recent applications in the submillimeter-wave range would greatly benefit from having large format heterodyne arrays, or namely terahertz cameras. For example, the imaging radar system presented in the second document cited above could speed up its acquisition time by having a focal plane array capable to image several pixels simultaneously.

A concept based on stacking multiple silicon layers has been proposed in the first document cited above. Such an assembly is expected to allow one to integrate an array of submillimeter-wave Schottky diode mixers and multipliers with MMIC amplifiers on the same wafer stack. However, in order to couple the RF signal, antenna technology that is consistent with silicon micro-fabrication is needed.

There is a need for improved methods of fabricating antennas operating at terahertz frequencies.

SUMMARY OF THE INVENTION

According to one aspect, the invention features a method of fabricating an antenna that operates at terahertz frequencies in a silicon material. The method comprises the steps of defining a geometrical pattern for an antenna that operates at terahertz frequencies, the antenna to be fabricated in a silicon material, the geometrical pattern configured to exhibit a desired range of directivity of electromagnetic radiation relative to the antenna, the geometrical pattern configured to exhibit an input reflection coefficient lower than a desired threshold value, the antenna when fabricated comprising at least one input waveguide for a signal to be emitted from the antenna; fabricating one or more silicon material segments, the one or more silicon material segments when assembled exhibiting the geometrical pattern defined in the previous step; and assembling the one or more silicon material segments to form the antenna that operates at terahertz frequencies.

In one embodiment, the fabricating step is performed using a photolithographic method.

In another embodiment, the fabricating step is performed using a laser machining method.

In yet another embodiment, the geometrical pattern is an array of spherical sections.

In still another embodiment, the geometrical pattern is an array of hemispherical sections.

In one more embodiment, the geometrical pattern is a one-dimensional array.

In still a further embodiment, the geometrical pattern is a two-dimensional array In a further embodiment, the geometrical pattern is a horn.

In yet a further embodiment, the at least one input waveguide is a square waveguide.

In an additional embodiment, the one or more silicon material segments comprises a segment having an iris defined therein.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 13A is a graph that illustrates the E-plane of the lens waveguide antenna as compared to a Pickett Potter horn antenna.

FIG. 13B is a graph that illustrates the H-plane of the lens waveguide antenna as compared to a Pickett Potter horn antenna.

DETAILED DESCRIPTION

A set of antenna geometries for use in integrated arrays at terahertz frequencies are described. Two fabrication techniques to construct such antennas are presented. The first technique uses an advanced laser micro-fabrication, allowing fabricating advanced 3D geometries. The second technique uses photolithographic processes, allowing the fabrication of arrays on a single wafer in parallel.

The present description addresses two approaches to fabricate an antenna array that can be used with the stacked structures referred to hereinabove. One approach uses advanced laser micro-fabrication, for example as described in V. M. Lubecke, K. Mizuno, G. M. Rebeiz; "Micromachining for Terahertz Applications", IEEE Trans. MTT, vol. 46, no. 11, pp. 1821-1831, November 1998.

The first approach allows fabricating advanced 3D geometries, and therefore one could envision fabricating an array of Picket-Potter horns (see P. D. Potter, "A new horn antenna with suppressed sidelobes and equal beamwidths", Microwave J., p. 71, June 1963) or silicon hemisphere lenses (see T. H. Buttgenbach, "An Improved Solution for Integrated Array Optics in Quasi-Optical mm and Submm Receivers: the Hybrid Antenna" IEEE MTT. vol 41, October 1993). A drawback of this approach is that it is a linear process which may not be cost-efficient, and therefore not practical, for large arrays in ground based applications as is the case of the imager radar.

Figure 1:
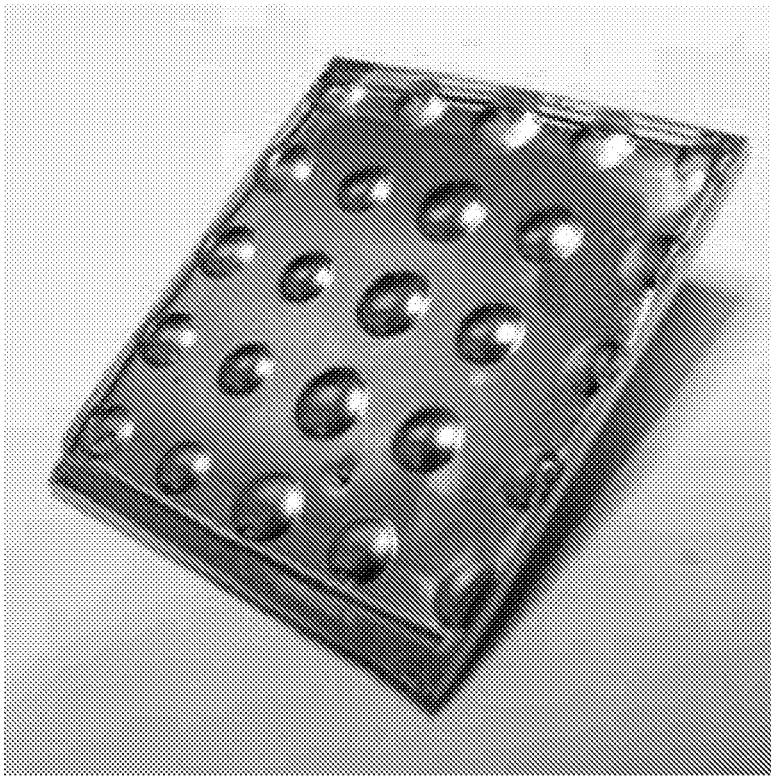
FIG. 1 is an image of an embodiment of an array of silicon micro-lenses.

A second approach uses photolithographic fabrication, as described in S.-K. Lee, M.-G. Kim, K.-W. Jo, S.-M. Shin and J.-H. Lee, "A glass reflowed microlens array on a Si substrate with rectangular through-holes" J. Opt. A. 10 (2008) 044003, 2008. The photolithographic technique allows the fabrication of arrays on a single wafer in parallel such as the fabrication of micro-thick lenses by reflowing a photo-resist material applied to a silicon object and then etching the silicon. A picture of an array fabricated using this approach is shown in FIG. 1.

Antenna Geometries

We describe several integrated antenna geometries that are expected to optimize the advantages of each of these techniques.

The antenna structures are intended to couple efficiently a waveguide mode to a certain optical system characterized by an f-number. Therefore, the antenna preferably should be directive and should be simple to integrate with the mixers and sources.

Antennas Fabricated Using Photolithographic Methods

An array of silicon lenses with a thickness of the order of a few hundred microns can be fabricated by reflowing a photo-resist material applied to a silicon layer and then etching the silicon. To illuminate such thin lenses, a directivity primary feed is needed in order to increase the effective f-number and improve the coating layer fabrication, spill over and off axis distortions. See, for example, D. F. Filippovic, S. S. Gearhart and G. M. Rebeiz, "Double Slot on Extended Hemispherical and Elliptical Silicon Dielectric Lenses", IEEE Trans. on MTT, Vol. 41, no. 10, October 1993. An air cavity can be used to illuminate the upper part of the lens with a directive primary feed, as well as to match the waveguide feed impedance with the silicon medium. See. For example, N. Llombart, G. Chattopadhyay, A. Skalare. I. Mehdi, "Novel Terahertz Antenna Based on a Silicon Lens Fed by a Leaky Wave Enhanced Waveguide", IEEE Trans. A P., accepted for publication. The geometry of such an antenna array is shown in FIG. 2.

The antenna directivity that is obtained depends on the diameter of the lens and not on the leaky wave feed properties. Therefore, the impedance bandwidth will be only limited by the cavity design, and not by the antenna directivity.

Figure 2:
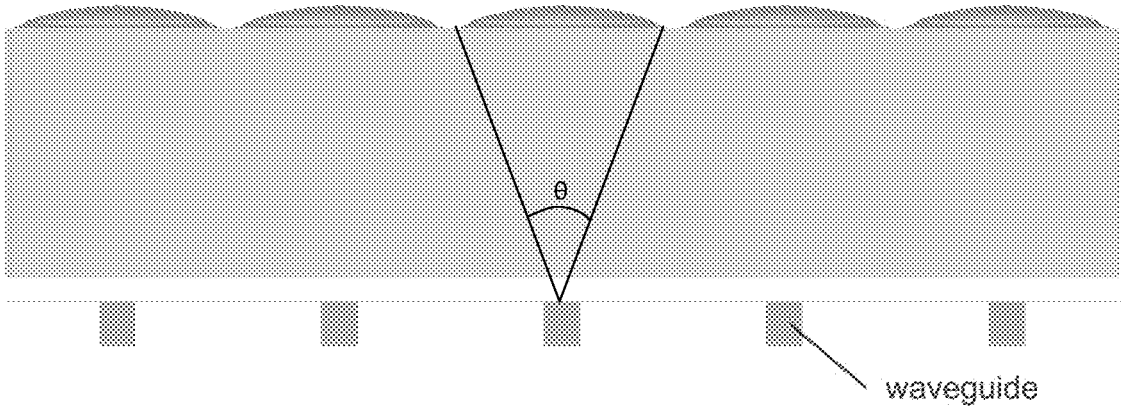
FIG. 2 is a cross sectional view of the micro-lens geometry of an array.
Figures 3A, 3B:
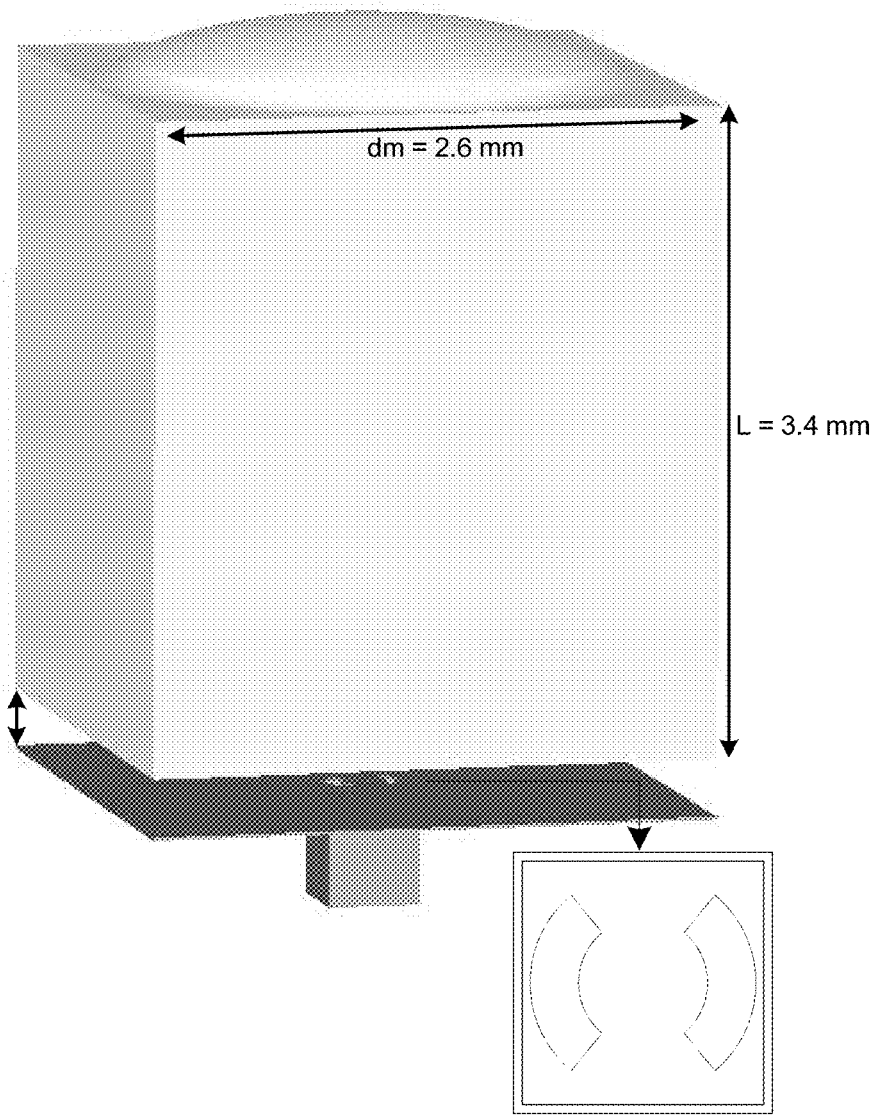
FIG. 3A is a perspective view of a silicon lens antenna geometry.
FIG. 3B is a plan view of the iris, which is a double arc slot etched through a ground plane. The iris is excited by a square waveguide shown at the bottom of FIG. 3A. The arrow pointing to the iris shows where the iris is located in FIG. 3A.

The fabrication of the array in FIG. 2 can be directly fabricated on a single wafer. See, for example, S.-K. Lee, M.-G. Kim, K.-W. Jo, S.-M. Shin and J.-H. Lee, "A glass reflowed microlens array on a Si substrate with rectangular through-holes" J. Opt. A. 10 (2008) 044003, 2008. The waveguide feeds can be constructed in another wafer, leaving the assembly of the antenna array to the stacking and alignment of only these two wafers. See FIG. 4A which shows a perspective view of a silicon lens antenna geometry fabricated using the photolithographic method.

Figure 4:
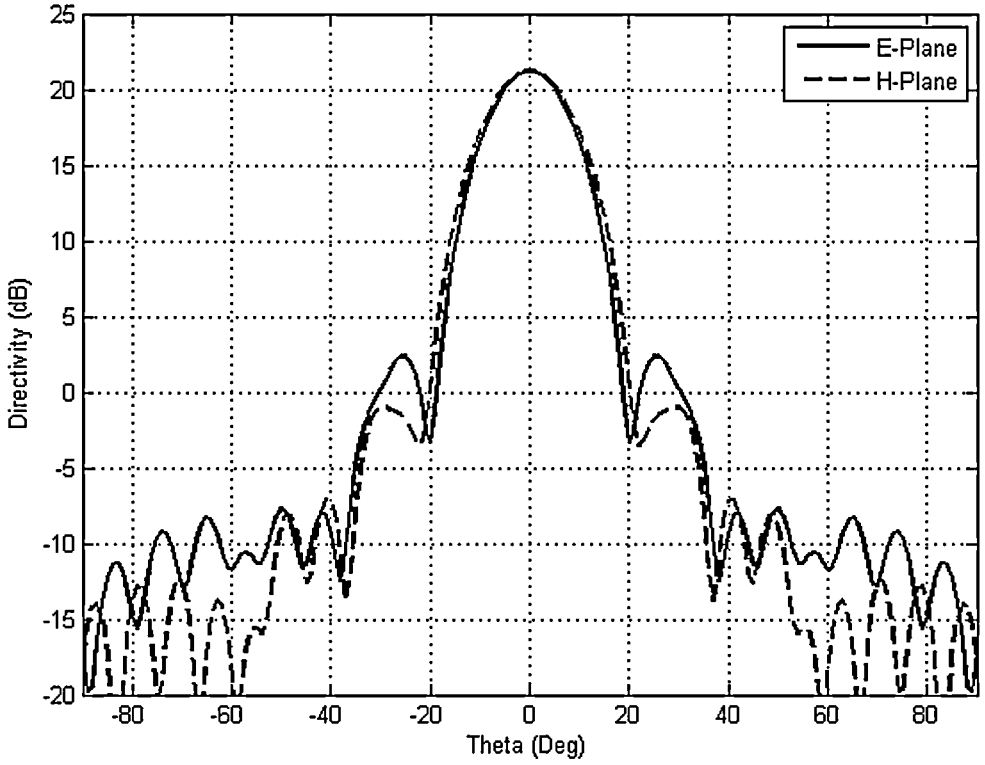
FIG. 4 is a graph illustrating the E-plane and H-plane radiation patterns at 550 GHz of the antenna shown in FIG. 3A.
Figure 5:
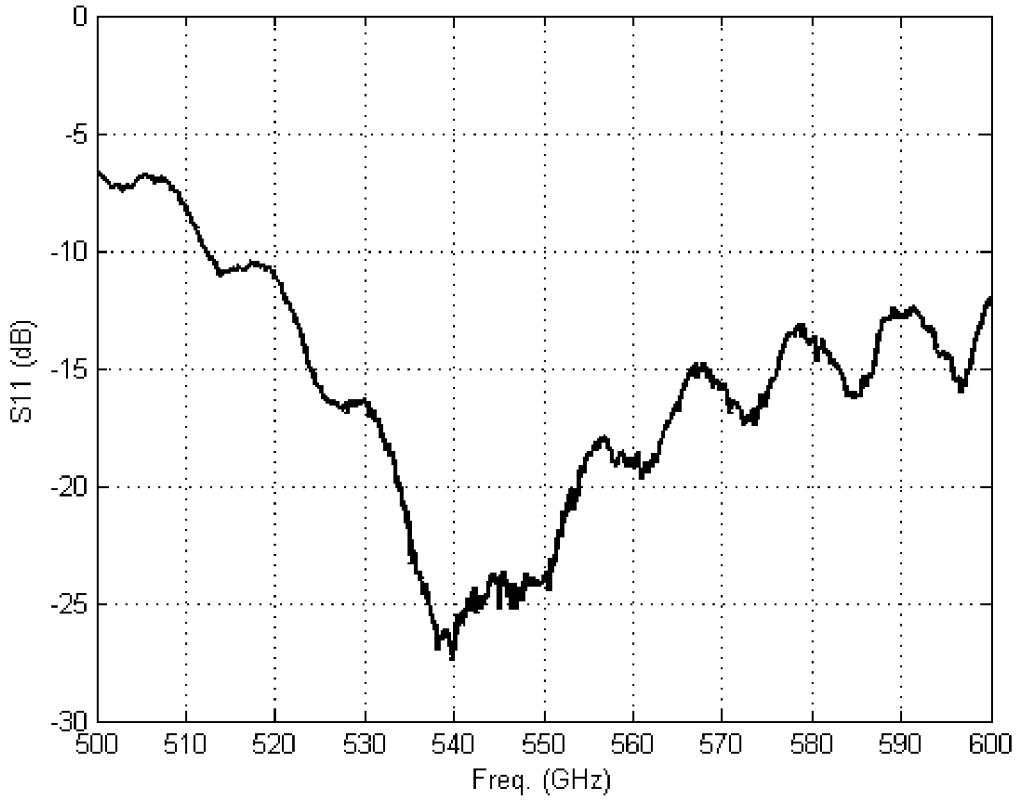
FIG. 5 is a graph showing the value of S11 of the antenna shown in FIG. 3A.

The antenna design has been validated with simulations with CST Microwave Studio at 550 GHz. CST MICROWAVE STUDIO® is a specialist tool for the 3D EM simulation of high frequency components available from Computer Simulation Technology AG, at CST of America®, Inc. 492 Old Connecticut Path, Suite 505, Framingham, Mass. 01701. Measurements of an embodiment are reported in N. Llombart, G. Chattopadhyay, A. Skalare. I. Mehdi, "Novel Terahertz Antenna Based on a Silicon Lens Fed by a Leaky Wave Enhanced Waveguide", IEEE Trans. AP., accepted for publication. FIG. 4 shows the radiation pattern and FIG. 5 shows the S11 that has been determined by simulation with CST.

Figure 6:
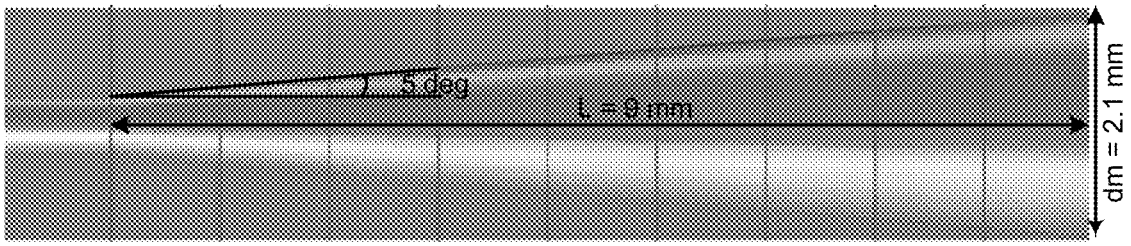
FIG. 6 is an image of one embodiment of a horn antenna made by stacking micro-machined gold plated silicon wafers.
Figure 7:
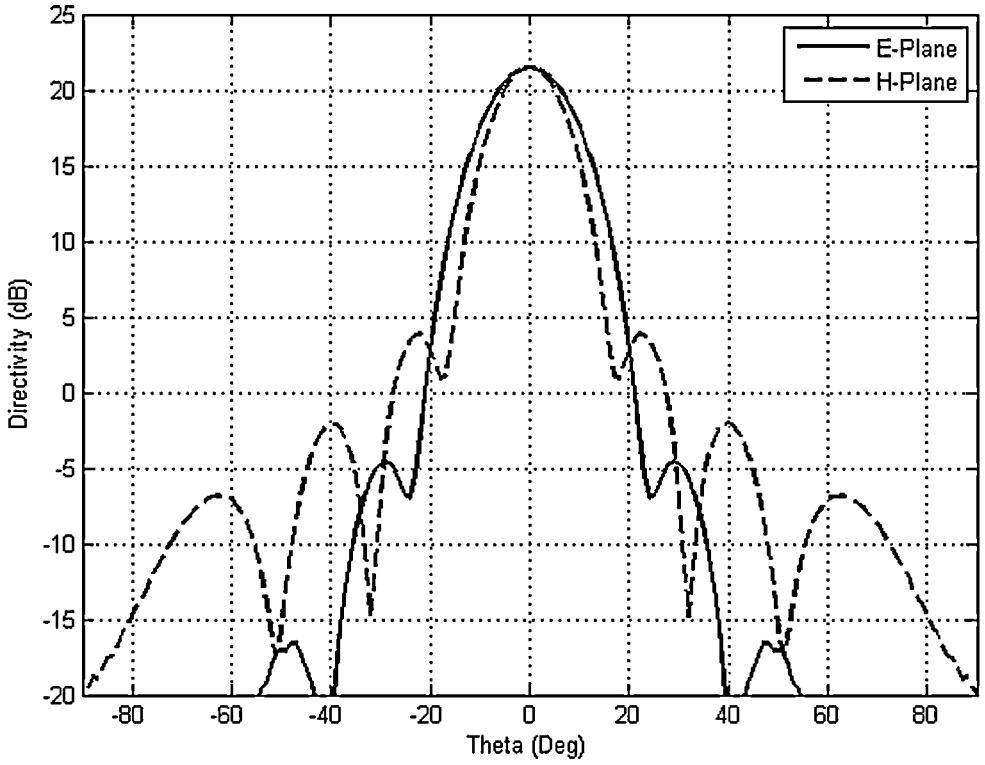
FIG. 7 is a graph illustrating the E-plane and H-plane radiation patterns at 550 GHz of the antenna shown in FIG. 6.
Figure 8:
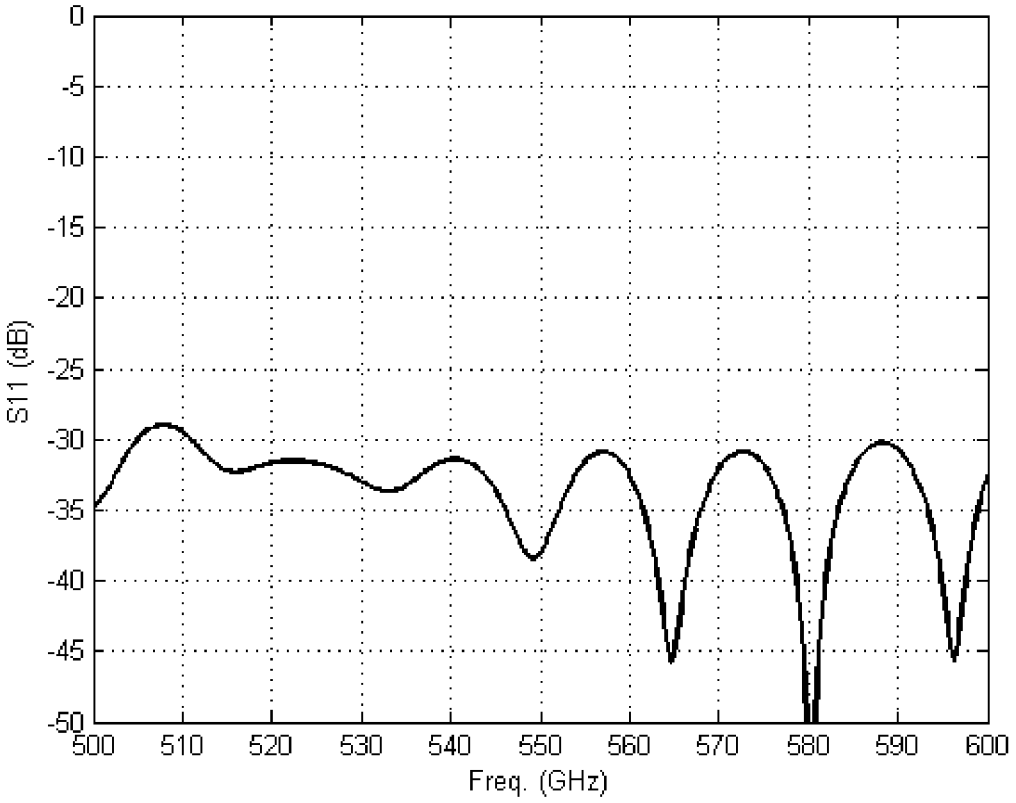
FIG. 8 is a graph showing the value of S11 input reflection coefficient of the antenna shown in FIG. 6.

Another approach to develop an array of antennas using a photo-lithographic process is to stack thin gold plated silicon wafers with tapered holes in order to build a horn, as illustrated in FIG. 6. The figure shows one-half side of the horn divided into 9 steps. The fabrication process over etches with a 5 degree angle each of the 9 wafers. All wafers have a thickness of 1 mm. After that, the wafers are assembled together to construct a conical horn as shown in FIG. 6. The horn operates at 550 GHz. FIG. 7 shows the simulated radiation pattern. FIG. 8 shows the simulated S11 input reflection coefficient of the antenna.

Antennas Fabricated Using Laser Machining

One can also fabricate the same antenna geometries previously described using a laser machining technique. Such lens design has an f-number around 1.9, which corresponds to a sector of 15 degree width (i.e. $\theta$ of FIG. 2 is equal to 30 degrees). This means that for a 5 mm diameter design, a silicon wafer of 9.5 mm thickness is needed. A similar thick wafer will be needed if one wants to fabricate a conical Potter horn array which has a small flare angle to avoid the excitation of higher order modes, as explained hereinabove.

However, in order to reduce the fabrication cost, antennas with a reduced thickness are advantageous. The laser machining technique can be used to fabricate a thicker lens.

Figure 9:
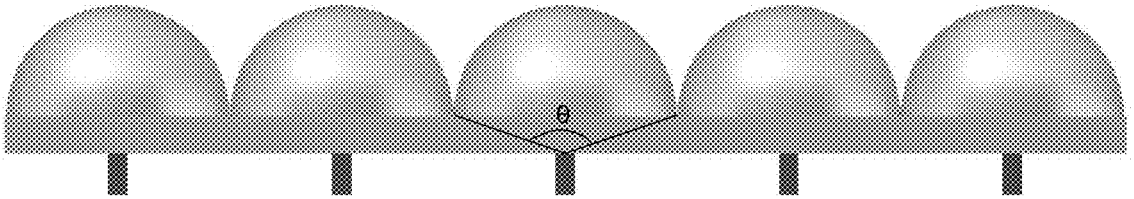
FIG. 9 is a cross sectional view of an array of waveguide coupled lenses.
Figure 10:
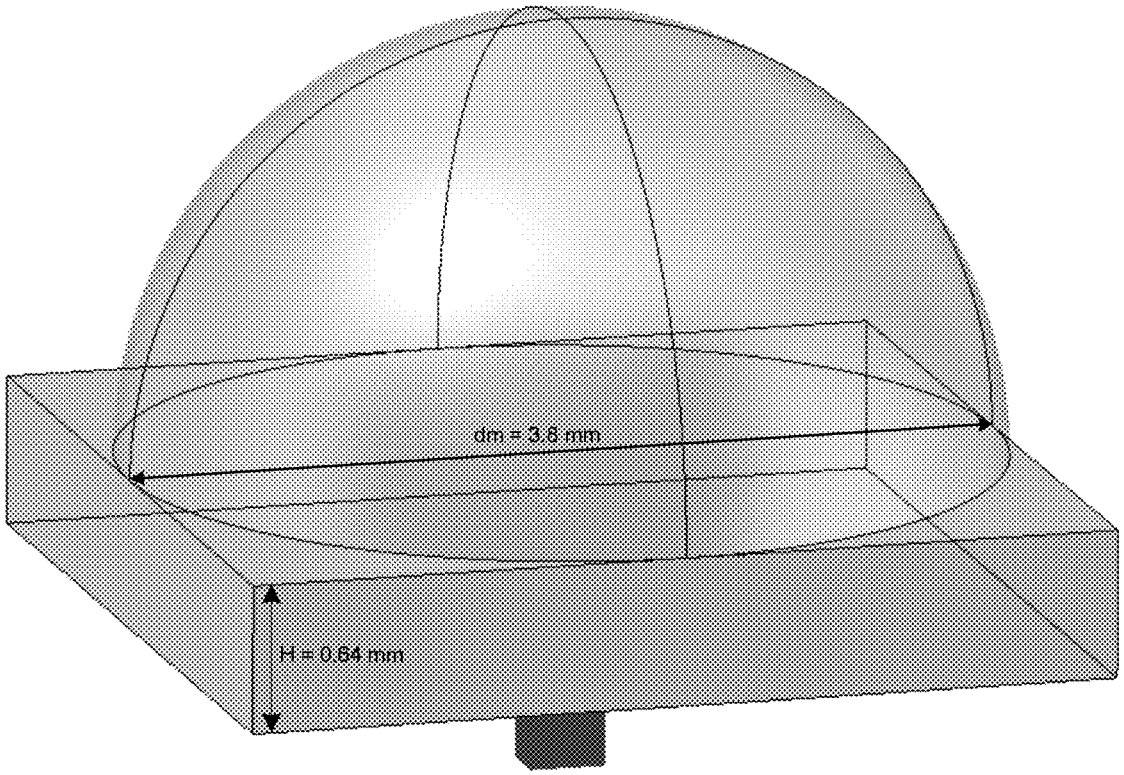
FIG. 10 is a diagram showing the detailed geometry of one lens in the array of waveguide coupled lenses of FIG. 9.

One embodiment involves the use of silicon hemisphere lenses coupled to a waveguide as shown in FIG. 9 and FIG. 10.

FIG. 9 is a cross sectional view of an array of waveguide coupled lenses.

FIG. 10 is a diagram showing the detailed geometry of one lens in the array of waveguide coupled lenses of FIG. 9.

Figure 11:
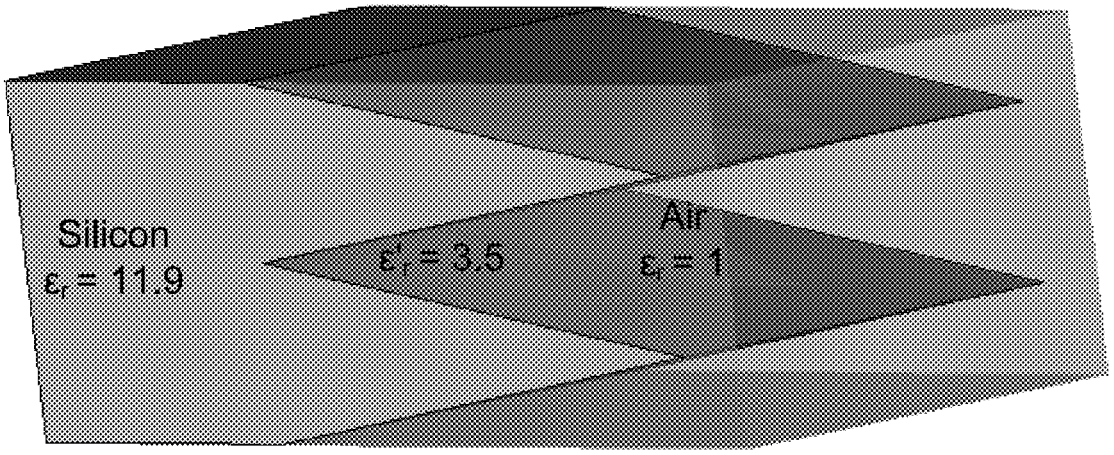
FIG. 11 is a diagram that shows the impedance matching at the waveguide transition from silicon to air.
Figure 12:
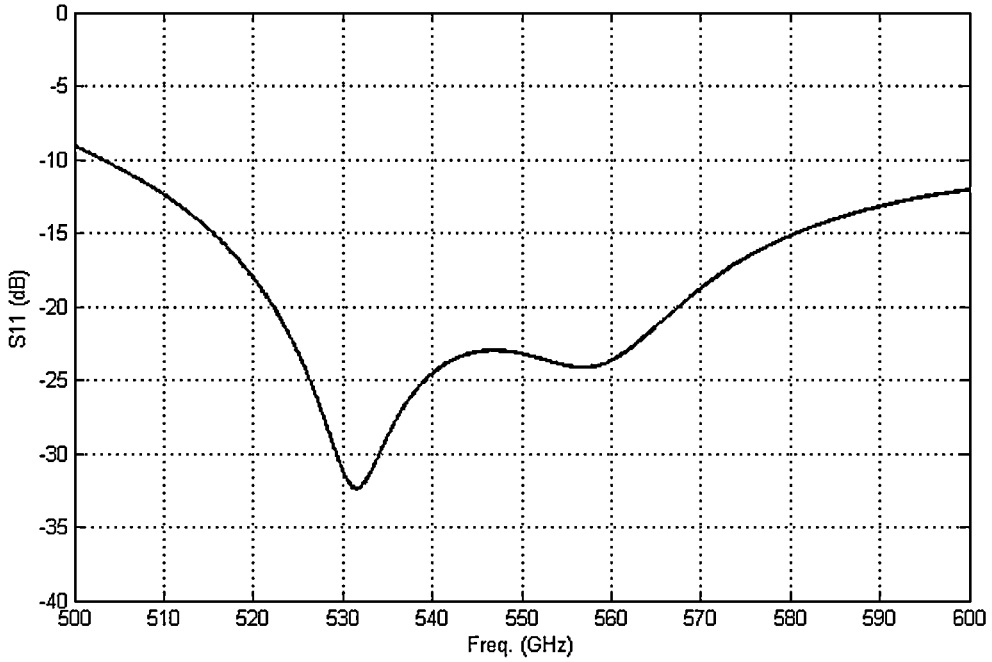
FIG. 12 is a graph showing the value of S11 input reflection coefficient of a waveguide with the impedance matching transition of FIG. 11.

The impedance match between the air waveguide and lens can be easily achieved with a taper silicon tip as shown in FIG. 11, which can be also fabricated with the same laser machining technique. FIG. 11 is a diagram that shows the impedance matching at the waveguide transition from silicon to air. The directivity of the primary field, i.e. field inside the dielectric, is defined by the dimension of the waveguide opening. The minimum opening is limited by the propagation of the TE10 mode in air and this will fixed the angular sector of the lens in FIG. 9. For the example shown here, this angle is 71 deg. FIG. 12 is a graph showing the value of S11 input reflection coefficient of a waveguide with the impedance matching transition of FIG. 11.

FIG. 13A is a graph that illustrates the E-plane of the lens waveguide antenna as compared to a Pickett Potter horn antenna.

FIG. 13B is a graph that illustrates the H-plane of the lens waveguide antenna as compared to a Pickett Potter horn antenna.

Micro-fabrication allows us to fabricate specific and precise 3D geometries. An embodiment involves an array based on extended silicon lens excited with a leaky wave waveguide feed. A second fabrication technique is based on photolithographic processes, which enables the fabrication of multiple arrays on a single wafer in parallel. One embodiment is an array of micro-lens. Another embodiment uses conical horns.

Definitions

Unless otherwise explicitly recited herein, any reference to an electronic signal or an electromagnetic signal (or their equivalents) is to be understood as referring to a non-transitory electronic signal or a non-transitory electromagnetic signal.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A method of fabricating an array of lens waveguide antennas, comprising the steps of:

forming an array of lenses in a first silicon wafer, wherein:

the first silicon wafer comprises a first surface and a second surface opposite the first surface, each of the lenses in the array of the lenses comprises a non-hemispherical curved section, and the forming of the array of the lenses further includes defining, in the first surface, the non-hemispherical curved sections and a planar section separating the non-hemispherical curved sections such that a tangent to each of the non-hemispherical curved sections at an intersection with the planar section is at an angle of more than 90 degrees with respect to the planar section; and forming an array of waveguides, comprising:

defining an array of waveguide shaped segments in the second surface, wherein each of the waveguide shaped segments are aligned with one of the non-hemispherical curved sections so that terahertz electromagnetic radiation outputted from one or more of the waveguide shaped segments is fed to the one or more non-hemispherical curved sections aligned with the one or more waveguide shaped segments, or defining the array of waveguide shaped segments in a second silicon wafer and aligning the second silicon wafer to the first silicon wafer so that the terahertz electromagnetic radiation outputted from the one or more of the waveguide shaped segments is fed to the one or more non-hemispherical curved sections aligned with the one or more waveguide shaped segments; and so that:

the array of lens waveguide antennas is formed, each of the lens waveguide antennas comprising one of the lenses and one of the waveguides.

2. The method of claim 1, wherein:

said defining the non-hemispherical curved sections includes photolithographically patterning and etching the non-hemispherical curved sections into the first surface, and said defining the waveguide shaped segments includes photolithographically patterning and etching the waveguide shaped segments in the second surface or the second silicon wafer.

3. The method of claim 1, wherein said defining includes laser machining.

4. The method of claim 1, wherein the non-hemispherical curved sections each comprise a spherical section.

5. The method of claim 1, wherein the array of the lens waveguide antennas comprises a one-dimensional array of the lens waveguide antennas.

6. The method of claim 1, wherein the array of the lens waveguide antennas comprises a two-dimensional array of the lens waveguide antennas.

7. The method of claim 1, wherein each of the waveguides in the array of the waveguides is a horn.

8. The method of claim 1, wherein each of the waveguides in the array of the waveguides include a square waveguide.

9. The method of claim 1, further comprising:

forming the array of waveguides in the second silicon wafer, defining an iris in the second silicon wafer, and assembling and aligning the first silicon wafer and the second silicon wafer so that each of the waveguides in the array of the waveguides feeds terahertz electromagnetic radiation to one of the lenses in the array of the lenses.

10. The method of claim 1, wherein each of the lenses in the array of the lenses comprises a microlens.

11. The method of claim 1, wherein each of the lenses in the array of the lenses comprises a plano-convex lens.

12. The method of claim 1, wherein the non-hemispherical curved sections each comprise a spherical cap that is less than a hemisphere.

13. The method of claim 1, further comprising:

forming the array of waveguides in the second silicon wafer, and assembling and aligning the first silicon wafer and the second silicon wafer so that each of the waveguides in the array of the waveguides feeds terahertz electromagnetic radiation to one of the lenses in the array of the lenses.

* * * * *